US008572783B2

(12) United States Patent
Moutafis

(10) Patent No.: US 8,572,783 B2
(45) Date of Patent: Nov. 5, 2013

(54) DEVICE FOR SUPPORTING A USER'S BODY

(75) Inventor: Timothy E. Moutafis, Gloucester, MA (US)

(73) Assignee: TheraTorr Medical, Inc., Beverly, MA (US)

( * ) Notice: Subject to any disclaimer, the term of this patent is extended or adjusted under 35 U.S.C. 154(b) by 857 days.

(21) Appl. No.: 12/448,027

(22) PCT Filed: Dec. 7, 2007

(86) PCT No.: PCT/US2007/025132

§ 371 (c)(1),
(2), (4) Date: Feb. 22, 2010

(87) PCT Pub. No.: WO2008/073326

PCT Pub. Date: Jun. 19, 2008

(65) Prior Publication Data

US 2010/0139003 A1 Jun. 10, 2010

Related U.S. Application Data

(60) Provisional application No. 60/873,742, filed on Dec. 9, 2006, provisional application No. 60/909,655, filed on Apr. 2, 2007.

(51) Int. Cl.
*B68G 5/00* (2006.01)
*A47C 16/00* (2006.01)

(52) U.S. Cl.
USPC ..... 5/655.3; 5/710; 5/654

(58) Field of Classification Search
USPC ..... 5/713, 710, 655.3, 654, 644
See application file for complete search history.

(56) References Cited

U.S. PATENT DOCUMENTS 3,467,973 A 9/1969 Minnick
3,605,145 A 9/1971 Graebe
3,822,425 A 7/1974 Scales (Continued)

FOREIGN PATENT DOCUMENTS

WO WO 00/72729 A1 12/2000
WO WO 01/01822 A1 1/2001

OTHER PUBLICATIONS

International Search Report and Written Opinion from International Application PCT/US2007/025132 dated Jun. 18, 2009.
Bellows "Air Bellows Series Numatics" 2006 34 pgs.

(Continued)

*Primary Examiner* — Robert G Santos
*Assistant Examiner* — Richard G Davis
(74) *Attorney, Agent, or Firm* — Wolf, Greenfield & Sacks, P.C.

(57) ABSTRACT

The invention provides a variety of devices for supporting at least a portion of a user's body. In some embodiments, the invention provides a support device which includes a bladder capable of containing a fluid and a post adjacent the bladder. The bladder may form a rolling diaphragm portion with the post such that when a force is applied to the bladder, the rolling diaphragm portion of the bladder rolls along the post decreasing the volume of the bladder. In some embodiments, the invention provides a post which includes a reduced cross-sectional area in comparison to an adjacent region of the post such that the resistance of the rolling diaphragm portion of the bladder to rolling movement along the post due to the applies force decreases as the bladder rolls along the reduced cross-sectional area region. In some embodiments, the support device includes a plurality of bladders and/or a plurality of posts.

34 Claims, 19 Drawing Sheets

(56) References Cited

U.S. PATENT DOCUMENTS

| | | | | |
|---|---|---|---|---|
| 3,870,450 | A | 3/1975 | Graebe | |
| 3,999,234 | A | 12/1976 | Regan | |
| 4,005,236 | A | 1/1977 | Graebe | |
| 4,134,168 | A | 1/1979 | Guigan | |
| 4,541,136 | A | 9/1985 | Graebe | |
| 4,542,547 | A | 9/1985 | Sato | |
| 4,617,690 | A | 10/1986 | Graebe | |
| 4,722,105 | A * | 2/1988 | Douglas | 5/713 |
| 4,799,276 | A | 1/1989 | Kadish | |
| 5,020,176 | A | 6/1991 | Dotson | |
| 5,052,068 | A | 10/1991 | Graebe | |
| 5,060,326 | A | 10/1991 | Oswald | |
| 5,090,077 | A | 2/1992 | Caden et al. | |
| 5,163,196 | A | 11/1992 | Graebe et al. | |
| 5,210,889 | A | 5/1993 | Wesemann et al. | |
| 5,332,202 | A | 7/1994 | Wagner et al. | |
| 5,414,874 | A | 5/1995 | Wagner et al. | |
| 5,435,023 | A | 7/1995 | Wagner et al. | |
| 5,446,933 | A | 9/1995 | Gabelhouse | |
| 5,502,855 | A | 4/1996 | Graebe | |
| 5,558,314 | A | 9/1996 | Weinstein | |
| 5,649,331 | A | 7/1997 | Wilkinson et al. | |
| 5,652,985 | A | 8/1997 | Wilkinson et al. | |
| 5,797,155 | A | 8/1998 | Maier et al. | |
| 5,836,027 | A | 11/1998 | Leventhal et al. | |
| 6,036,271 | A | 3/2000 | Wilkinson et al. | |
| 6,487,738 | B1 | 12/2002 | Graebe | |
| 6,591,437 | B1 * | 7/2003 | Phillips | 5/713 |
| 6,721,981 | B1 | 4/2004 | Greenhaigh et al. | |
| 6,739,009 | B2 * | 5/2004 | del Drago | 5/713 |
| 6,829,797 | B2 | 12/2004 | Partian | |
| 6,898,814 | B2 | 5/2005 | Kawamura et al. | |
| 7,069,610 | B1 | 7/2006 | Chai | |
| 7,251,845 | B2 * | 8/2007 | Schaller et al. | 5/613 |
| 2003/0037377 | A1 | 2/2003 | Kawamura et al. | |

OTHER PUBLICATIONS

Control Air Inc. "Rolling Diaphragm Air Cylinders" Jun. 2, 2004 12 pgs.

Fader "Effects of absorbent incontinence pads on pressure management mattress" Issues and Innovations in Nursing Practice, 2004 pp. 569-574.

Maklebust et al. "Pressure Relief capabilities of the sof-care bed cushion and the clinitron bed" Journal for Extended Patient Care Management, vol. 21 Winter 1988.

Myers et al. "Computer-controller, air-modulated mattress for the prevention of decubiti" Technology for the Aging, Annual Int. Conf. of IEEE Engineering in Medicine and Biology Society, vol. 13, No. 4, 1991.

Small "Flat circular punch testing of clinical support surfaces" Engineering in Medicine, 1980, pp. 9-15.

Todd et al. "Polyurethane foams: effects of specimen size when determining cushioning stiffness" Dept. of Veterans Affairs, Journal of Rehab Research & Develop. vol. 35, No. 2, Jun. 1998, pp. 219-224.

Extended European Search Report for Application No. 07862665.2 mailed Mar. 29, 2012.

International Preliminary Report on Patentability for Application No. PCT/US2007/025132 mailed Jun. 18, 2009.

* cited by examiner

DEVICE FOR SUPPORTING A USER'S BODY

RELATED APPLICATIONS

This application is a national stage of International Application Ser. No. PCT/US2007/025132, filed Dec. 7, 2007, which claims the benefit under 35 U.S.C. § 119(e) of U.S. Provisional Application Ser. No. 60/873,742, filed Dec. 9, 2006 and U.S. Provisional Application Ser. No. 60/909,655, filed April 2, 2007.

FIELD OF THE INVENTION

The present invention relates generally to devices for providing support to at least a portion of a user's body, and in particular to a device which may adjust the pressure on certain portions of the user's body.

BACKGROUND OF THE INVENTION

Various types of support devices, such as mattresses, cushions, chairs, are known to support a user's body. A conventional mattress may include an array of spring elements to support a body. When a user lays on a conventional mattress, the springs compress. As the level of compression increases, the resistive force in the springs increase as a result of user's weight on the mattress. This increased resistance tends to focus on protruding regions of patient anatomy which may cause lesions such as pressure ulcers, or other local circulatory problems, especially in bedridden patients. Protuberant regions of the anatomy are more prone to develop pressure sores because they tend to penetrate more deeply into mattresses, encountering greater forces than nearby regions and thus are more likely to have diminished local blood circulation.

Areas of a patient's body exposed to higher pressures when positioned on a support device, i.e., pressure points, are undesirable. Current methods to reduce pressure points on bedridden patients involve frequently moving or rotating the position of the patient on the support device so that a pressure point does not lead to the above-mentioned lesions. While this approach may be helpful, it requires someone, such as a nurse, to physically move the patient. This is time consuming and may also lead to injuring the nurse and/or the patient.

SUMMARY OF INVENTION

Aspects of the present invention are directed to a support device which helps to minimize pressure points on a user's body when the user is supported by the device. By minimizing the pressure points on a user's body, aspects of the present invention are directed to reducing the incidence of pressure ulcers and local circulatory problems.

Certain embodiments of the present invention are directed to providing a support device with a low interface pressure. By providing a low interface pressure, the certain embodiments of the present invention may reduce the need to move and/or rotate a bedridden patient as frequently.

In one embodiment, a device is provided for supporting at least a portion of a user's body. The device includes a bladder capable of containing a fluid, and a post adjacent the bladder. The bladder forms a rolling diaphragm portion with the post such that when a force is applied to the bladder, the rolling diaphragm portion of the bladder rolls along the post, decreasing the volume of the bladder.

In certain embodiments, the invention provides a support device with the above described bladder and post where the cross-sectional area of the post varies along its to length. As set forth in greater detail below, altering the cross-sectional area of the post can alter the amount of resistance of the bladder to the rolling movement along the post. In one embodiment, the post includes at least one region having a reduced cross-sectional area in comparison to an adjacent region of the post such that the resistance of the rolling diaphragm portion of the bladder to rolling movement along the post due to the applied force decreases as the bladder rolls along the at least one region having the reduced cross-sectional area.

In certain embodiments, the invention provides support device for supporting at least a portion of a user's body. The support device includes a plurality of bladders capable of containing a fluid, where the plurality of bladders includes at least a first bladder and a second bladder. The support device further includes a plurality of posts adjacent to and supporting the plurality of bladders, such that at least one post is positioned adjacent to and supports each of the plurality of bladders. The plurality of posts include at least a first post and a second post, with the first post positioned adjacent to and supporting the first bladder and the second post positioned adjacent to and supporting the second bladder. The first and second bladders each forms a rolling diaphragm portion with the first and second posts, respectively, such that when a force is applied to the first bladder, the rolling diaphragm portion of the first bladder rolls along the first post decreasing the volume of the first bladder, and when a force is applied to the second bladder, the rolling diaphragm portion of the second bladder rolls along the second post decreasing the volume of the second bladder.

In certain embodiments, the invention provides a device for supporting at least a portion of a user's body. The device includes at least one bladder capable of containing a fluid, and a plurality of posts adjacent the at least one bladder. The plurality of posts includes at least a first post and a second post. At least a portion of the at least one bladder forms a first and second rolling diaphragm portion with the first and second posts, respectively, such that when a force is applied to the at least one bladder at a location adjacent the first post, the first rolling diaphragm portion of the at least one bladder rolls along the first post decreasing the volume of the at least one bladder, and when a force is applied to the at least one bladder at a location adjacent the second post, the second rolling diaphragm of the at least one bladder rolls along the second post decreasing the volume of the at least one bladder.

BRIEF DESCRIPTION OF DRAWINGS

The accompanying drawings are schematic and are not intended to be drawn to scale. In the figures, each identical, or substantially similar component that is illustrated in various figures is typically represented by a single numeral or notation. For purposes of clarity, not every component is labeled in every figure, nor is every component of each embodiment of the invention shown where illustration is not necessary to allow those of ordinary skill in the art to understand the invention. In the drawings.

DETAILED DESCRIPTION

The present invention provides a device for supporting a portion of a user's body. It should be appreciated that in some embodiments, the device may be part of and/or may form a mattress. In other embodiments, the device may be part of and/or may form a chair, and in yet other embodiments, the device may be part of and/or may form a cushion or pillow or other support surface/device or portion thereof.

Certain embodiments of the support device include bladders with portions which act as a rolling diaphragm. In particular, the support device may include at least one bladder and a post positioned adjacent to and supporting the bladder. The bladder may include a rolling diaphragm portion capable of rolling along the post. The rolling diaphragm portion of the bladder may roll along the post in response to a force applied to the bladder. The position of the bladder with respect to the post can affect the volume within the bladder. In one embodiment, the volume of the bladder decreases and increases as the bladder rolls along the post in a first and second direction of travel, respectively.

The inventive support device will now be described in more complete detail in the context of several specific embodiments illustrated in the appended figures. It is to be understood that the embodiments described are for illustrative purposes only and that to the inventive features of the invention, as described in the appended claims, can be practiced in other ways or utilized for instruments having other configurations, as apparent to those of ordinary skill in the art.

Figure 1:
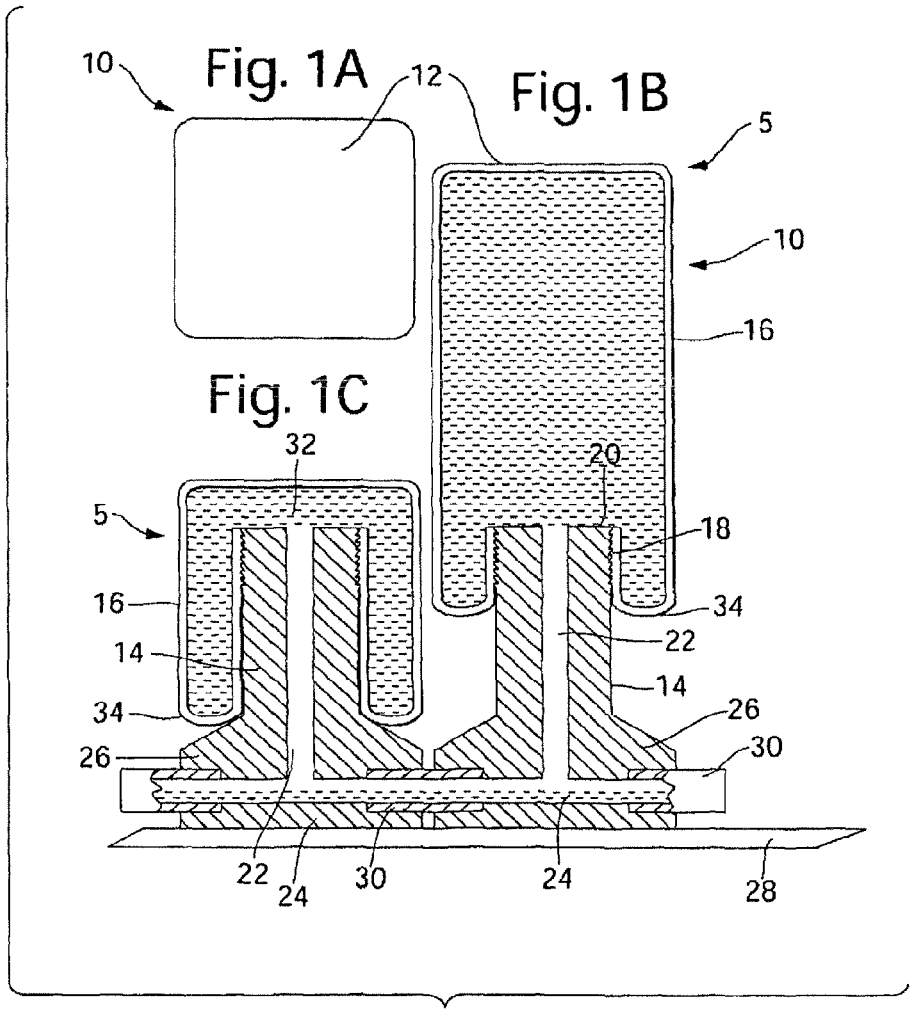
FIGS. 1A-1C are schematic cross-sectional illustrations of a support device according to one embodiment.

Certain embodiments of the present invention are directed to a support device which may include one or more bladders 10 capable of containing a fluid. The embodiment illustrated in FIG. 1 depicts a pair of support devices 5, each including a fluid-filled bladder 10 with an adjacent post 14. The dashed region in FIGS. 1B-1C illustrates the fluid within the bladders 10.

It should be appreciated that the bladder 10 and posts 14 may be made of a variety of materials as the invention is not so limited. For example, the bladder 10 may be made from materials such as, but not limited to various flexible and substantially fluid impermeable material like rubber and various plastic materials, and the post may be made from materials such as plastic materials, metals, wood, etc. without limitation.

In one embodiment, the bladder is constructed of a fabric coated with or molded to an elastomer. The elastomer may be a natural rubber or a synthetic compound, and may, for example be between approximately 30-90 shore D durometer. In one embodiment, the fabric may be a cotton, polyester, polyester, such as polyethylene, or KEVLAR®, obtained from DuPont. In one embodiment, the thickness of the bladder is between approximately 0.01-0.04 inches. In one particular embodiment, the bladder is made from a non-latex elastomer, such as neoprene, with a cotton embedded fabric. The thickness of the bladder material may be approximately 0.03 inches and the expanded bladder diameter may be approximately 2 inches.

In one embodiment, the post 14 may be made from ABS (Acrylonitrile butadiene styrene), polycarbonate, PVC (Polyvinyl chloride), or styrene. As discussed in greater detail below, in some embodiments, the post 14 is a rigid structure, whereas in other embodiment, the post 14 is a resilient structure, and may for example be inflatable.

Some of the below-mentioned embodiments utilize air as the fluid within the bladder. It is also contemplated that other fluids, including other gases as well as liquids, such as water, may also be employed. It should also be recognized that the fluid may be temperature controlled.

FIG. 1A is a top view of one bladder 10, illustrating one embodiment with an approximately square upper surface 12. In another embodiment, the bladders 10 may be shaped differently as the present invention is not limited in this respect. For example, in one embodiment, the bladder 10 may be approximately hexagonal and/or approximately round in shape rather than square.

In one embodiment, the upper surface 12, and/or the upper portion of the walls 16 of the bladder 10, may include a patient-contacting finish or layer, which may include various types of foam, gel, and/or padding.

FIG. 1B illustrates a cross-section of a bladder 10 and a post 14 on which it may be coupled. In this particular embodiment, the side wall 16 of the bladder 10 is coupled at region 18 to the post 14 by adhesive or other coupling. In this particular embodiment, the side wall 16 of the bladder 10 passes downward initially, then curves upward in region 34 and runs upward to top surface 12 of the bladder. In one embodiment, the post 14 includes a channel or passage 22 which fluidly connects a fluid duct 24 running through the base region 26 of post 14 with the inside of the bladder 10. The base region 26 may be connected to a supporting frame 28. Fluid ducts 24 may be connected by connectors 30 to each other, or to tubing (not illustrated) to form a support device including a fluidly connected array of bladders 10 and posts 14.

The support device 5 is typically at a given pressure P (not labeled), which in one embodiment, is the same for all bladders 10 within a device, or within one or more specific regions or zones of a device 5. As discussed in greater detail below, the posts 14 may be disposed in one or more separately pressure regulated regions or zones, and may also be connected to a fluid pressurizing system to fill the bladder with fluid, such as, but not limited to, an air compressor, a fan, a pump for liquid or air, or a liquid reservoir raised to an appropriate height above the connectors 30 (not illustrated).

The fluid ducts 24 may be coupled via connectors 30 which are able to withstand the anticipated pressures in the device. In one embodiment, the pressure within the device is between approximately 0.1-1 psig. In another embodiment, the pressure within the device may be as much as approximately 1-10 psig or more. It should be appreciated that a larger pressure may be useful to elevate or move patients. The pressure may be regulated by a pressure regulator of any type, and/or a centrifugal pump, and the system pressure may be variable with time, or zoned, or both, as described below. Local controls may regulate particular zones of the device, using conventional electric and fluidic control devices. In another embodiment, posts 14 may be mounted directly into a manifold, and the manifold is fluidically connected to the rest of the device, for example through valves or regulators.

FIG. 1C illustrates an embodiment similar to the that shown in FIG. 1B, except the bladder 10 has been pushed in a downward direction by an applied force. In this configuration, the bladder 10 forms a rolling diaphragm as the bladder wall 16 has rolled down the post 14 until curved region 34 has contacted the base 26 of the post 14. As shown, the interior volume 32 of the bladder shown in FIG. 1C is smaller than the interior volume 32 of the bladder shown in the configuration shown in FIG. 1B. In this particular embodiment, the fluid lost in pressing down the top surface 12 of the support device 5 in FIG. 1C exits through the fluid passages 22, fluid ducts 24, and connectors 30. In one embodiment, the fluid passage 22 is approximately 0.06 inches in diameter and is approximately 1 inch in length. In one particular embodiment, the fluid passage 22 is formed with a hole axially extending through a fastener, such as a screw.

In one embodiment, the distance the bladder wall 16 is capable of rolling down the post 14 from its fully extended position (such as FIG. 1B), before encountering any region of increased post diameter (e.g. base 26, such as in FIG. 1C), may be at least approximately 50% or more of the length of the post. In another embodiment, the bladder wall 16 is capable of traveling along at least approximately 70% or more of the length of the post, and in yet another embodiment, the bladder wall 16 is capable of traveling at least approximately 80% or more of the length of the post.

As illustrated in FIGS. 1B-1C, in one embodiment, a plurality of bladders 10 may be fluidically interconnected so that the pressure within a first bladder is capable of reaching an equilibrium with the fluid pressure within a second bladder. In one illustrative embodiment, the fluid duct 24 and fluid passage 22 extending through the posts 14 fluidly connects the first and second bladders 10. It should be appreciated that in other embodiments, the fluid pressure within the first bladder may be capable of reaching an equilibrium with the fluid pressure within a second bladder 10 through various types of conventional sensors as the invention is not so limited.

Figure 2A:
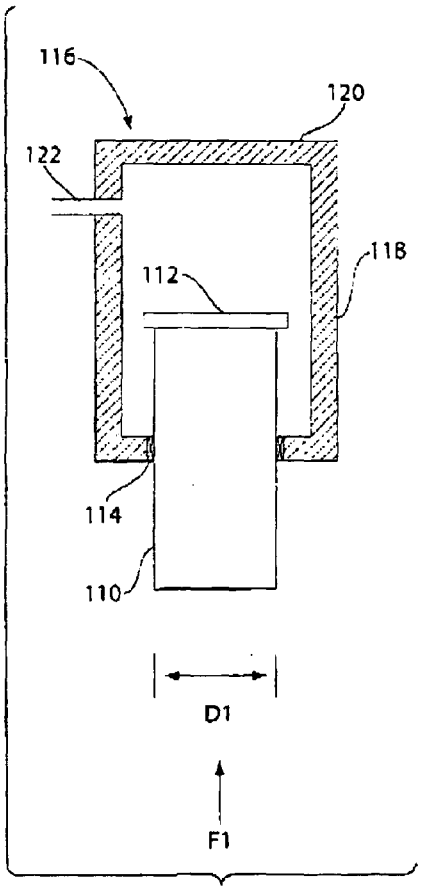
FIGS. 2A-2B are schematic cross-sectional illustrations of two posts having different cross-sectional areas.
Figure 2B:
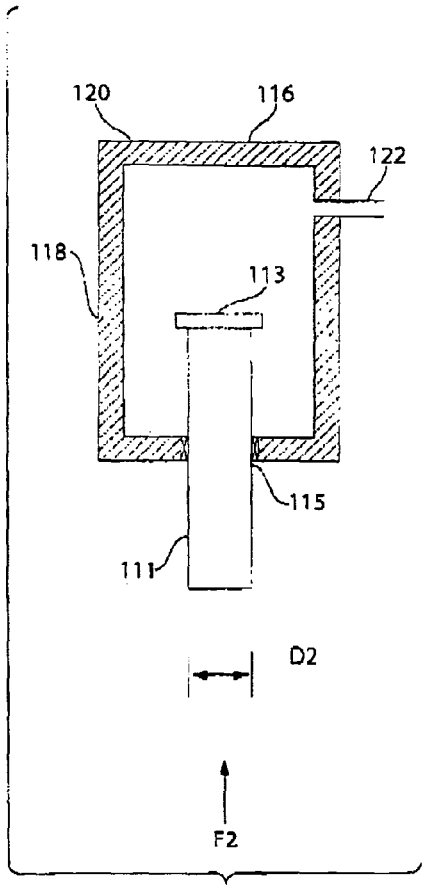

Turning now to the schematic illustrations shown in FIGS. 2A and 2B, the mechanistic basis for one embodiment of the support device according to the present invention is more fully described. To better enable the understanding of the support devices, a simple mechanical analogy is shown in cross section in FIGS. 2A-2B. In FIG. 2A, a piston 110, having a diameter D1 and a top surface 112, passes through a sealing ring 114 into a cylinder 116 having a side wall 118, a top surface 120 and an air outlet 122.

If the cylinder 116 is supplied with air at pressure P, then to prevent the piston from moving, a certain force, F1, will be required to prevent the piston 110 from being forced out of the cylinder by pressure P. The required force will be proportional to the cross-sectional area of the piston 110 where the piston passes through the sealing ring 114. If the piston is cylindrical in shape, the required force will be proportional to the square of the diameter D1 of the piston 110 where it passes through the sealing ring 114 into the cylinder 116. If the actual force applied is greater than F1, the piston will enter the cylinder, and unless pressure P is increased, the piston will eventually reach the top 120 of the cylinder 116.

FIG. 2B is similar to FIG. 2A except that piston 111 has a smaller diameter, D2, with an upper end 113, and going through a smaller sealing ring 115. A smaller force, F2, proportional to the square of the diameter D2 of the portion of the piston passing through the seal 113, will be required to maintain the piston 111 in place, or to force it into the cylinder 118. Note that the appropriate place to measure the diameter to determine the force to prevent motion is at the seal, and not at the inward ends 112, 113. For example, one could place a thin plate on end 113 of FIG. 2B that was as big as that of end 112 of FIG. 2A, and as long as the plate did not make sealing contact with the walls of the cylinders 118, it would make no difference to the force required to balance the respective pistons 110, 111 against pressure P.

FIGS. 2A-2B are similar to FIGS. 1B-1C, with the cylinder 118 analogous to bladder 10 and pistons 110 or 111 analogous to post 14. In one embodiment, instead of a sliding seal 114 or 115 and motion of a piston through it, the curved region 34 of the bladder 10 acts as a rolling diaphragm moves up and down with respect to the top surface 20 of the post 14. The diameter and geometry of post 14 may be selected to control the critical intra-bladder pressure Pc, below which critical pressure a given weight will start to depress the upper surface of a bladder 10.

Figure 3A:
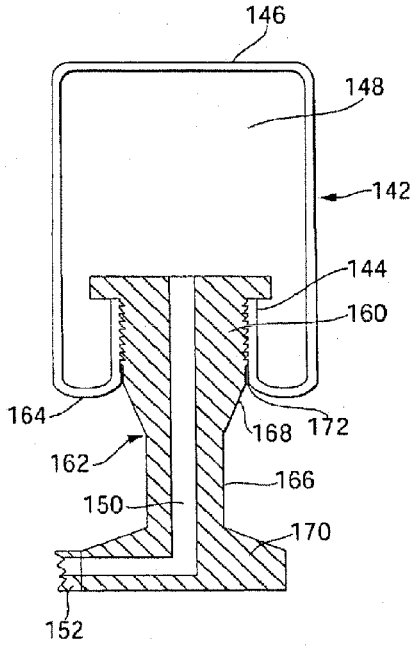
FIGS. 3A-3B are schematic cross-sectional illustrations of a support device in a first position and a second position according to another embodiment.
Figure 3B:
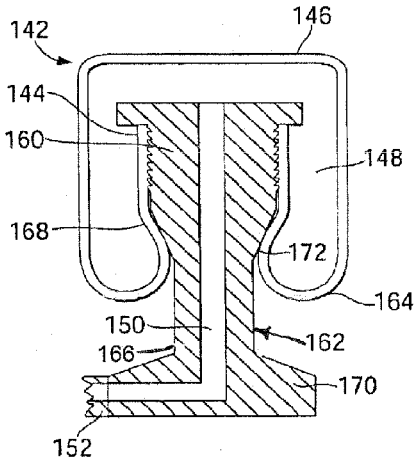

In one embodiment, the resistance of the bladder 10 to the rolling movement along the post 14 due to an applied force may decrease as the bladder 10 moves along certain regions of the post. As shown in FIGS. 3*a* and 3*b*, in one embodiment, a support device is provided where the resistance of the bladder to losing volume decreases as the top surface 146 of the bladder is pressed downwards. In other words, as a person sinks part of their anatomy into the support device, such as a mattress, and pushes below the surface, the reaction force or upward pressure is reduced as deflection is increased. This is in sharp contrast to typical support devices, such as s spring mattress, where as the deflection is increased, the force of resistance of the spring would increase. This decreasing resistance behavior can be measured with exemplary data being provided below.

In one embodiment, this is accomplished by including a post 162 with a reduced cross-sectional area in comparison to an adjacent region of the post 162. In the embodiment illustrated in FIGS. 3A-3B, the post's outer diameter tapers, either smoothly or abruptly at a defined depth of travel from the top surface. In FIG. 3A, the post 162 has an upper region 160 with a larger diameter and a lower region 166 of reduced outer diameter, with a transition region 168 having a varying diameter in between. The bladder 142 has top surface 146, a seal 144, and may be generally similar to the bladders of previous embodiments. The post 162, includes a fluid flow lumen 150 in fluid communication with a connector 152 With no weight or force applied, and when inflated by a positive system pressure, the bladder 142 will have a chamber 148 inflated to its maximum volume.

FIG. 3B illustrates the effects of applying weight above the critical pressure to the support of FIG. 3A. As such a weight is applied to top surface 146, the bladder 142 is compressed and the volume of chamber 148 decreases, and the rolling diaphragm portion or dependent region 164 increases in depth (i.e. moves towards base 170 of post 162). The balloon-like bladder's folded under outer surface 172 may be maintained in contact with the post 162 by the pressure in the bladder. As shown in FIG. 3B, the bladder 142 may eventually contact the reduced diameter section found in region 166 of post 162. As noted above, the effective area of the "piston" here resisting further displacement forces (the post 162 in FIGS. 3A-3B) is less when the curved region 164 of the bladder is positioned opposite a smaller diameter post region 166 (FIG. 3B) than when it is positioned opposite a larger diameter post region 160 (FIG. 3A). In the illustrated embodiment, once the curved region 164 of the bladder reaches the narrower post beginning at region 168, it takes less force to push the bladder further down onto the post, because the pressure in the device is available over a smaller area. Thus, as the bladder is pushed downward onto a tapered post, the resistance to movement further decreases. As shown, the rolling diaphragm portion 164 may be approximately annular in shape as it rolls along the post 162. As the cross-sectional area of the post 162 decreases, the inside diameter of the annular shaped rolling diaphragm portion 164 may also decrease as it may be pulled inwardly to follow the contour of the post 162.

This is in contrast to a conventional spring mattress or sealed fluid bladder mattress where the resistance to movement would increase as the springs or sealed bladder is compressed. It should be appreciated that the decrease or reduction in slope of the force versus displacement curve and the effective range of such a decrease is dependent on the exact geometry of the posts with respect to height, taper and/or rate of change of the cross-sectional area of the taper.

In the embodiment illustrated in FIGS. 3A-3B, the substantially straight or linear constant-force region 160 at the top of the post 162 is relatively short, proportionally, in the vertical dimension in comparison to the remaining lower portion 166 of the post. In one embodiment, for example, when the support device is a cushion for sitting, a short region of constant force may be appropriate. In another embodiment, such as when the support device is a mattress, a longer distance of travel, i.e. a larger straight or linear constant-force region at the top of the post before the resistance begins to decrease, may be more appropriate. In this particular embodiment, the taper in region 168 is of an "S" type, going through a curved surface from a first constant diameter to a second constant diameter. It should be appreciated that other patterns are also contemplated, such as, but not limited to a gradual taper, an abrupt taper or step change after a constant diameter section, or any number of other configurations.

Moreover, the contrast in diameter between regions of the post is depicted in the figures as a large difference to make its effects easier to visualize. In one embodiment, the post of the support device may have more subtle tapers. For example, in one embodiment, the decrease in the cross-sectional area of the post is in the range of approximately 1% to approximately 50%. In another embodiment, the decrease in the cross-sectional area of the post is in the range of approximately 5% to approximately 35%, and in yet another embodiment, the decrease in cross-sectional area of the post is in the range of approximately 10% to approximately 30%. Exact ranges of taper (rate of diameter decrease), or ratio between largest and smallest diameters or areas of parts of a post, may be selected based upon a particular application and/or user's medical condition.

In the embodiment illustrated in FIGS. 3A-3B, the post includes a base 170 which, as shown, tapers outwardly. Because the cross-sectional area of the base 170 is greatly increased in comparison to other parts of the post, a much larger force would be required to further move the bladder along the base 170 of the post. In certain embodiments, an outwardly tapered base 170 may be provided so that the movement of the bladder 142 stops once the bladder reaches the base 170. This may help to create a soft bottoming (i.e. preventing direct contact of the user's body with the posts, and/or minimize its impact). As mentioned above, in one embodiment, the posts 162 are inflatable, and may be held at a pressure greater than system pressure in the bladders. As noted above, the pressure in the bladders may be less than 1 PSIG (pressure above atmospheric.) In this respect, any contact between the user's body and the posts may be cushioned. It is also contemplated to include a resilient material on the top surfaces 146 of bladders and/or as part of the posts to further provide cushioning.

Figure 4A:
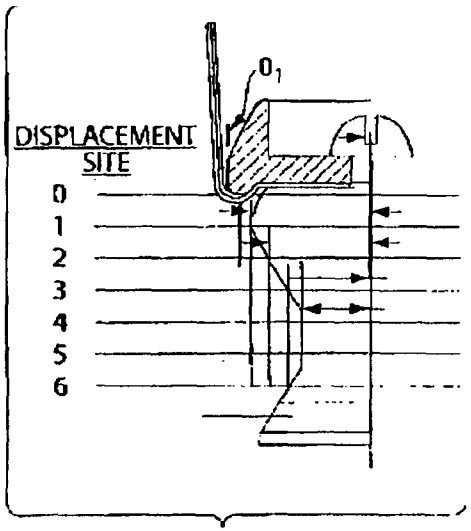
FIGS. 4A-4C are schematic illustrations of three differently shaped posts along the stroke axis illustrating the different pressure and reaction force characteristics associated with the different posts.
Figure 4B:
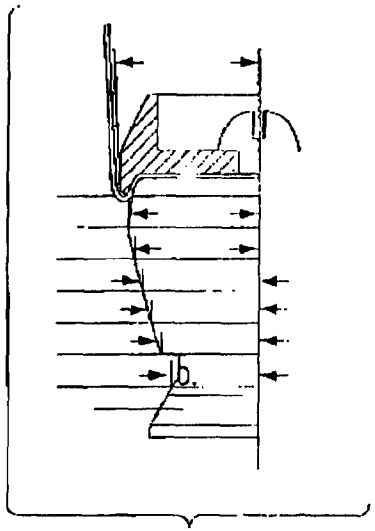
Figure 4C:
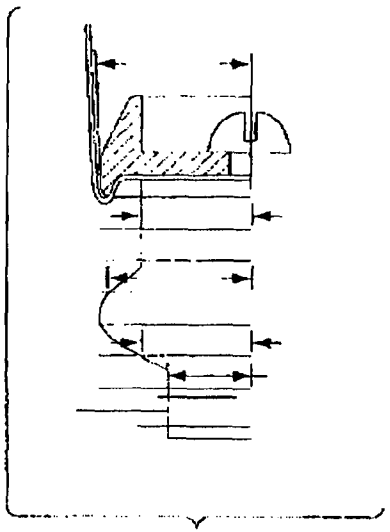

FIG. 4 illustrates three differing geometries for the post each with a distinct load-deflection curve and overall reduction in force applied to the portion of patient adjacent the post supported by the bladder despite increasing load applied from the top. In each embodiment, the module (i.e. a bladder/post combination) support force is the combination of the normal (axial) force due to the changing cross sectional area of the post and the modulation effects of the increasing or decreasing annular shape of the rolling diaphragm portion of the bladder.

Figure 5A:
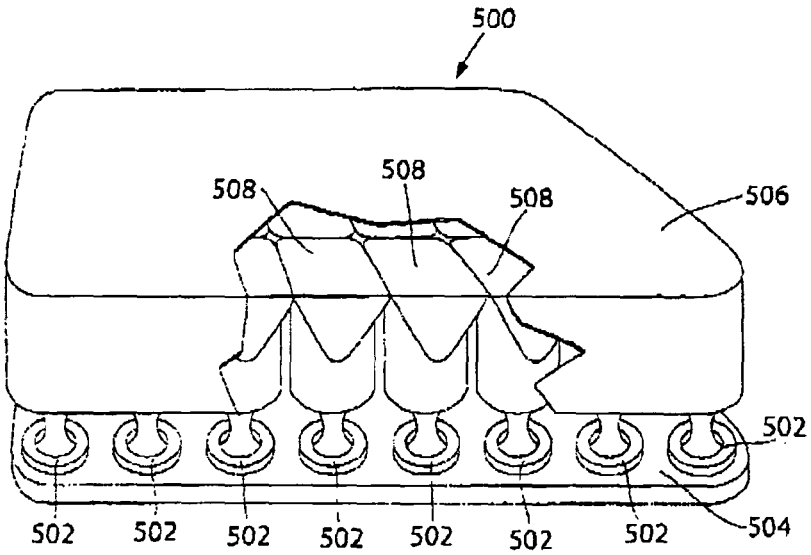
FIGS. 5A-5C are schematic illustrations of a support device including a blower for air pressure delivery and a pressure controller.
Figure 5B:
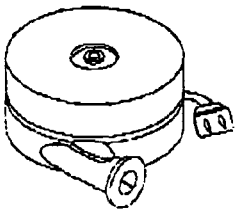
Figure 5C:
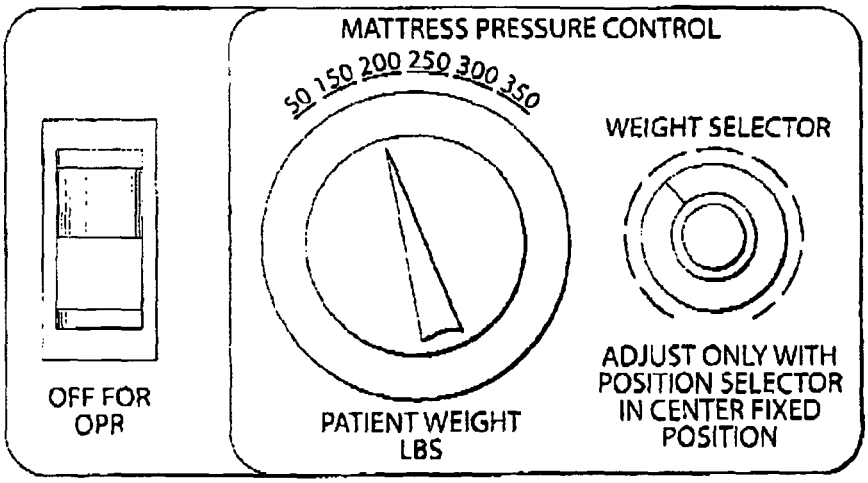

FIGS. 5A-5C illustrates various components of one embodiment of a support device of the invention 500, where the support device is a mattress with modules 502 (i.e. bladder/post combination) in place at the bottom frame 504. In this embodiment, the bottom frame 504 is a thin plenum which fluidly connects a plurality of bladders together. (FIG. 5A). In one embodiment, the bottom frame 504 supports these modules and the bottom frame 504 may also be inflatable to provide additional cushioning to a user. It should be appreciated that the figure is not drawn to scale, but, the basic configuration of the modules is shown. In this particular embodiment, the support device includes a cover 506, which is discussed in greater detail below. As shown in FIG. 5B, the support device also includes a blower in conjunction with a readily available pressure pump control (FIG. 5C) interconnected in operative association with the modules of FIG. 5A in a manner that would be apparent to those skilled in the art. Together these components comprise a basic support device unit according to one embodiment of the present invention. In one embodiment, this basic unit may operate in a static mode (i.e., no air infusion into the bladders 508 at constant inflation). In another embodiment, this unit may operate in an alternating pressure mode (i.e. air inflow/pressure changing according over time using the simple blower and the control unit), and in another embodiment, the unit may operate in a ventilation mode with constant air infusion, for example by perforating the tops of the bladders as is done for typical ventilation mattress. Furthermore, the surface of each module top may include material including foam, gel, padding or other material or combinations as desired or a patient contacting surface that is disposable and conforming to the underlying surface retaining the pressure relieving benefits.

Figure 6A:
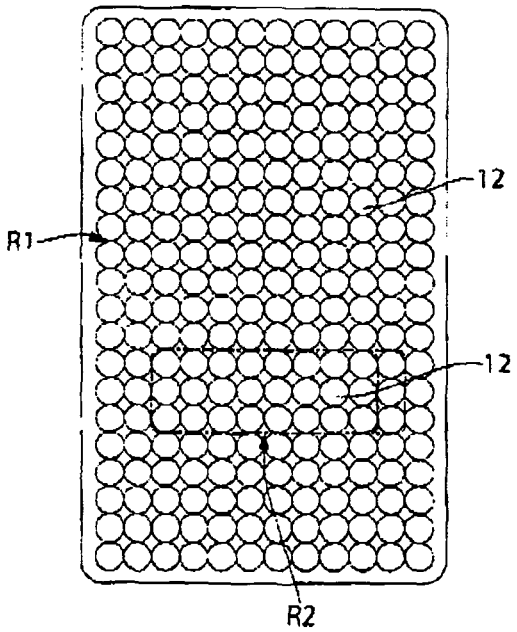
FIGS. 6A-6B are schematic illustrations of a support device including a plurality of zones according to another embodiment.

FIG. 6A illustrates a support device comprising a two dimensional array of inflated bladders having upper, load-bearing surfaces 12 which may initially all be inflated to have essentially the same volume and be pressurized to a first pressure P1. In one embodiment, the array is surrounded by a side frame (not illustrated) to maintain the bladders in position. In such embodiments, the side frame will typically be connected to a bottom frame such as bottom frame 28 of FIG. 1 or bottom frame 504 of FIG. 5. Such a configuration may serve to create a complete mattress replacement system.

If an irregular object, for example, all or a part of a human body, is applied to the array, and the load per module exceeds pressure P1 at any point, then protruding sections of the object may contact surfaces 12 first, and those surfaces may be the first areas to compress. As more of the object comes in contact with additional bladder surfaces 12 as the object sinks into the array, the weight of the object may be distributed over a larger and larger set of surfaces 12. If the pressure P1 is above a certain threshold, then at some point, enough surfaces 12 may be engaged that the weight pressing on each will be below the weight needed to begin to roll the bladders along the posts, and the object will stabilize and not sink any further into the array.

In one embodiment, it may be made easier for a patient to get into/onto a support device comprising a large array of bladders, such as a mattress, by raising the internal bladder pressure to a relatively high pressure so that the mattress will remain firm while the patient initially sits/lies on it or gets off it. Once the patient is situated, the pressure may be reduced so that the patient sinks into the mattress sufficiently to spread his weight over a larger number of bladders.

The required supporting pressure may be quite small. For example, if the area of the patient's torso including buttocks is about 300 square inches, and the patient weighs about 200 lbs, the required pressure to support the patient is about 0.67 PSI, when lying on his back or stomach. In contrast, when a patient "sinks" into a conventional mattress, the local pressure per unit area may be considerably higher on protruding areas such as the buttocks, and especially on the hip bones when lying in the side. Because in certain embodiments, at least some of the module bladders may be interconnected in fluid communication such that the pressure in each fluidically interconnected module will be essentially the same or, in other embodiments, the pressure in different bladders may be independently set and/or controlled, protrusions on a patient's body will not be subject to increased force applied by the support, but can be subject to essentially the same level of force or even a lesser level of force than surrounding areas of the patient's body depending on the particular shape and configuration of the post geometry of the modules and/or the particular module pressure and the associated force/displacement response as described previously.

Thus, aspects of the present invention are directed to a support device, such as a mattress, which may reduce the pressure on any particular area of the body of a patient (e.g. a protruding area) with respect to the average pressure exerted on overall area of contact of the mattress with the patient's body, dictated by the patient's weight and cross-sectional area of contact with the support device, in a particular position, compared to conventional support devices. This effect is not readily achieved with a conventional mattress or even a conventional air bed, each of which tends to exert higher forces per unit area on protruding areas of a patient which leads to pressure points.

The present invention is also directed to support devices and methods of use which may selectively reduce the resistance to displacement in areas supporting protuberant regions of the user's body. According to one embodiment, the support device is capable of selectively reducing the resistance in areas of protuberant regions of a user's body by reducing the critical pressure of the bladders in a zone where the protuberant regions are located. In one embodiment, this may be done by having multiple zones of differing air pressure and/or multiple zones of modules having posts of differing geometry. For example, as shown in FIG. 6A, there can be a small zone R2 with a lower pressure in the middle of a larger region R1 having higher pressure. As the patient sinks into the mattress support device, the bladders in zone R2 will yield first, putting more of the patient's weight on areas of the body lying on zone R1 with higher pressure. This will likewise reduce the pressure on the selected area of the patient. The resistance to further penetration of the mattress support device may be such that there may be significantly decreased pressure supporting the protuberant areas.

In a another embodiment, a region R2 of bladder surfaces 12 may have posts of a smaller cross sectional area than the posts in a surrounding array region R1. When at least a portion of a user's body is positioned on the array at R2, it may sink more rapidly when pressing on modules having posts of smaller area. As the user's body sinks into the array, it will begin to encounter surfaces 12 supported by posts of larger area in region R1, and may encounter greater resistance. When sufficient surfaces are encountered, the load will be supported at some pressure uniform pressure P in the bladders in both the R1 and R2 zones (i.e. as would be the case if the modules were interconnected in fluid communication with each other; however, in the R2 zone, the modules with posts of lesser cross-sectional area will not require as much force applied by the patient areas above and supported by such modules to create displacement, and so in that region of the body contacting region R2, the force applied to the body during movement will be less, essentially according to the ratio of the cross-sectional areas of the posts in region R2 to those in region R1. At equilibrium, the pressure will be the same on all of the body's surface; however, during any subsequent motion, there will be less pressure applied to the area of the body that is positioned over region R2.

One embodiment of the present invention includes a support device in the form of cushion, mattress or other support containing an array of bladders supported on an array of posts. A cushion support device may have at least one region similar to R2 in which the fluid pressure supplied to the bladders in the region, for example a region contacting a particular part of the body, is less than that supplied to bladders in a surrounding area. In particular, pressure on a region of the body may be lessened during contact or motion when the body region is in contact with region R2, while higher pressure may be experienced by the body in a contiguous region or regions R1. Such a device may be useful in treating, for example, a broken coccyx, or in curing a pressure sore on the buttocks, or in relieving pressure on an area that has been sutured, skin grafted, burned or otherwise is undergoing healing or treatment.

In certain embodiments of the invention, a region R2 of a cushion support device has an array of bladders on posts characterized in that the posts in the region R2 have a smaller diameter than posts in a surrounding region R1. This may reduce the required yield pressure for displacement the bladders in region R2, so that the weight of the body is borne preferentially by the bladders in the surrounding region R1.

In another embodiment, a region R2 has both a lower pressure, and smaller diameter posts, in comparison to a surrounding region R1, combining the effects of the previous embodiments.

In any embodiment of the above types, valve arrangements or other pressure/flow control arrangements capable of isolating individual bladders/post modules or zones of bladders and posts, for example similar to regions R2 as shown in FIG. 6, may be used to vary pressure to create a desirable pattern of resilience and resistance to displacement over the overall area of the support device and/or to facilitate moving a patient along the surface of a mattress or other device. Local pressure variation may also be implemented on a programmed basis to help stimulate healing of a lesion. For example, selected regions may have their pressures changed over timescales of seconds, minutes or hours, to improve local blood flow. In a post and bladder system according to the present invention, such pulsations may reduce the pressure on the affected areas when the system pressure is transiently reduced. Local pressure regulation may also be employed for devices according to the invention configured for treating regions of a patient body not on the trunk of the body, such as heels or elbows, where pressure can be adjusted to be locally lower, e.g. to simulate a sensation of "weightlessness.". For embodiments in which the bladders may by directly connected to each other, any such connection may advantageously provide excess surface/material of connection to accommodate significant differences in bladder heights while preventing tension from arising between adjacent bladders, or within covering materials attached to the top surfaces of the bladders due to the interconnection. It is also contemplated that pressure/flow control arrangements may be configured to inflate and/or deflate certain rows and/or columns of the support device in various patterns to help reposition or rotate the patient.

Figure 6B:
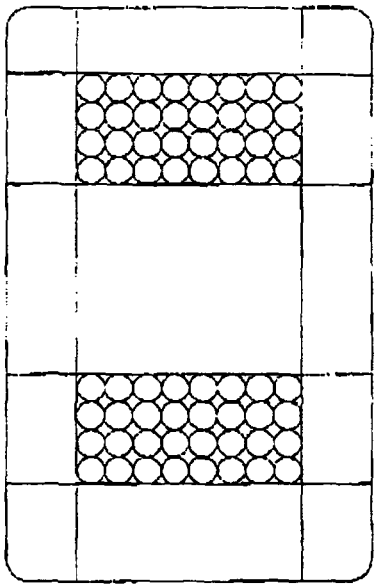

FIG. 6B illustrates another embodiment in which any of the above-described support device module characteristics may be selectively incorporated into any array of existing beds, systems or other surfaces comprised of all available materials such as foam, springs, fluid filled bladders, air filled bladders, gel materials, alternating pressure and ventilation systems. Discrete zones of actuated and/or programmed modules may be beneficial in conjunction with some existing systems as illustrated.

Figure 7A:
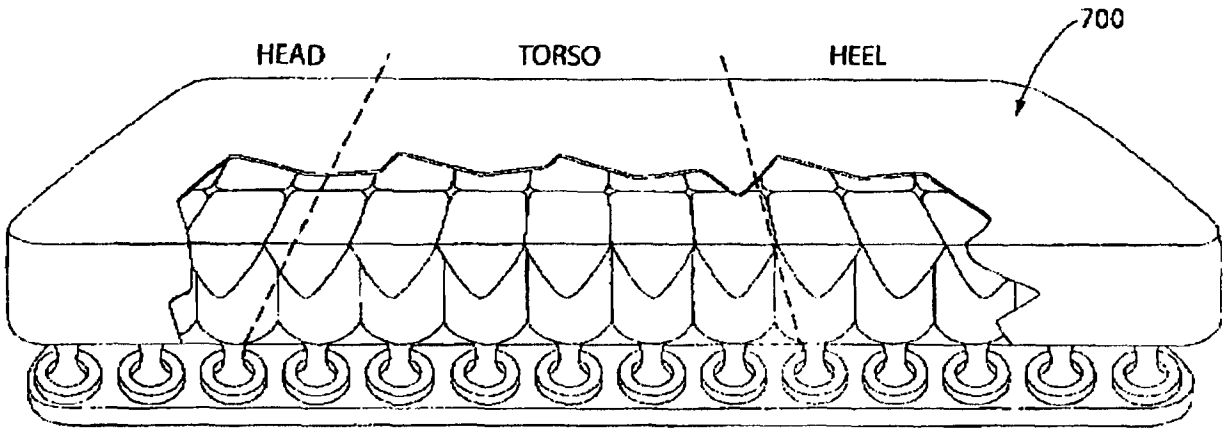
FIGS. 7A-7C are schematic illustrations of a support device including a plurality of zones according to another embodiment for use in a hospital bed with a Personal Digital Assistant.
Figure 7B:
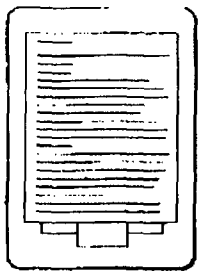
Figure 7C:
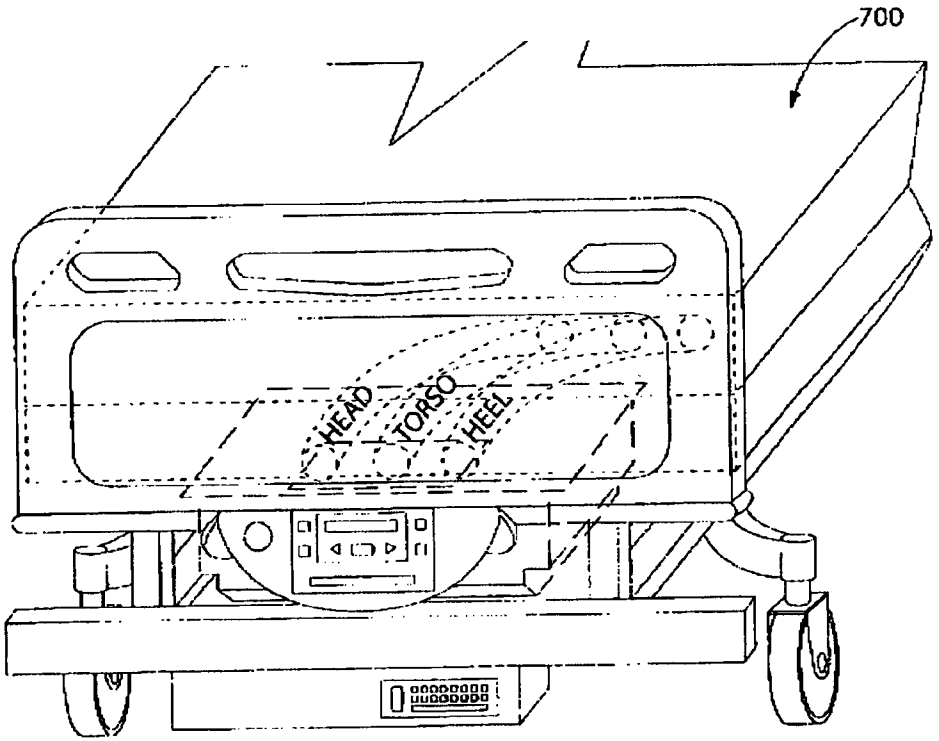

FIGS. 7A-7C illustrate how differing regions of a mattress support device 700 coupled with an air pressure controller and air pump (not illustrated), may for example be used as a hospital bed (FIG. 7C). FIG. 7B illustrates a hand held Personal Digital Assistant (or in other embodiments a personal computer or other controller or computing device) which may be configured to interface with control hardware of the support device and programmed/configured to monitor, control and/or report the air flow and pressure and/or other parameters relevant to operation of the support device, for example as needed to optimize the pressure reduction therapy for the patient.

Figure 8A:
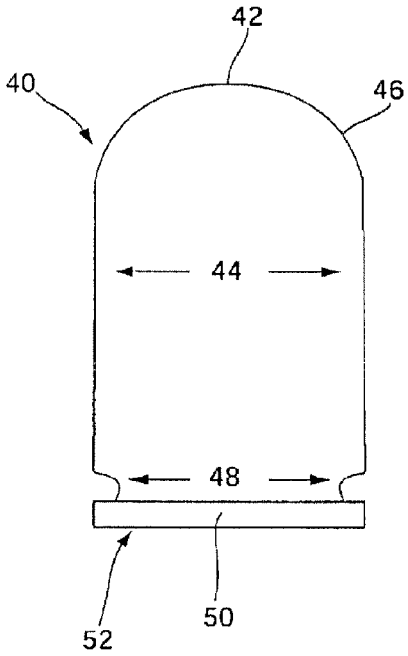
FIGS. 8A-8B are schematic illustrations of a support device including perforations for ventilation according to another embodiment.
Figure 8B:
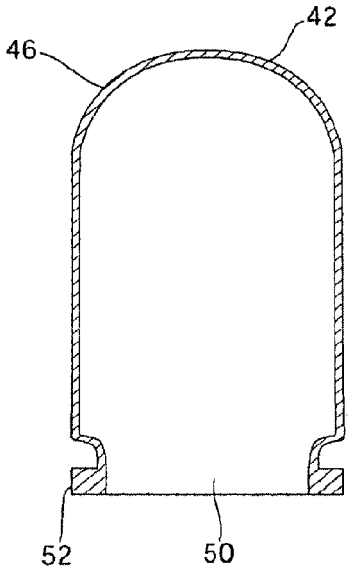

FIGS. 8A and 8B illustrate an exterior view (FIG. 8A) and a cross sectional view (FIG. 8B) of another embodiment of a bladder 40 of the present invention. In this particular embodiment, the profile of the top surface 42 of bladder 40 is domed. It should be appreciated that in other embodiments, the bladder 40 may be generally square, hexagonal, round or elliptical, as the present invention is not so limited. It should also be recognized that the outer shape of the bladder 40 may change depending upon the amount and pressure of fluid within the bladder. In one embodiment, the bladders are shaped and arranged to minimize any space between adjacent bladders. The side wall 46 may have a uniform thickness, which may, for example, be about 0.03 inch (ca. 0.7 mm). In another embodiment, the thickness may range from less than 0.01 inch to over 0.05 inch. The selected thickness may depend on the tensile properties of the fluid-impermeable material used for the bladders, on the desired maximum system pressure, and on the anticipated lifetime of the device, particularly if parts are disposable. In addition, all or part of the bladder may have flocked, textile, or other coatings for patient contact, which may be thicker than the fluid-impermeable material of the bladders. The bladders may also be reinforced.

In one embodiment, the bladder 40 may have a cross-sectional width 44 of about 2 inches (ca. 50 mm), so that 800 bladders in an array of 20×40 bladders would have a surface about 40 inches wide and 80 inches long, similar to a conventional mattress. Other sizes of bladders are also contemplated, and different sizes of bladders may be placed in the same array. In one mounting system, the bladder 40 may be formed to taper to a cross section width 48 at its mouth that is smaller than the width 44 of the main portion of the bladder, and may have a collar 50 with a rim 52 for mounting to a post. For example, when width 44 is about 2 inches, mouth width 48 may be about 1.6 inches, and collar 50 might have a thickness 52 of about 0.1 inches (ca. 2.5 mm).

Figure 9A:
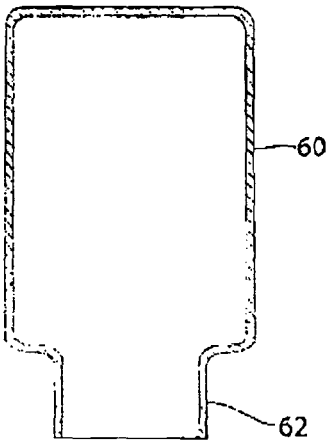
FIGS. 9*a*-9*h* are schematic illustrations of a bladder being coupled to a post according to other embodiments.
Figure 9B:
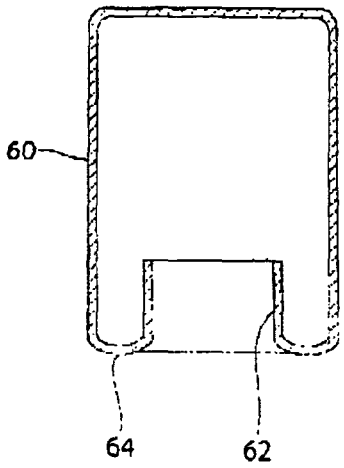
Figure 9C:
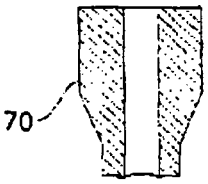
Figure 9D:
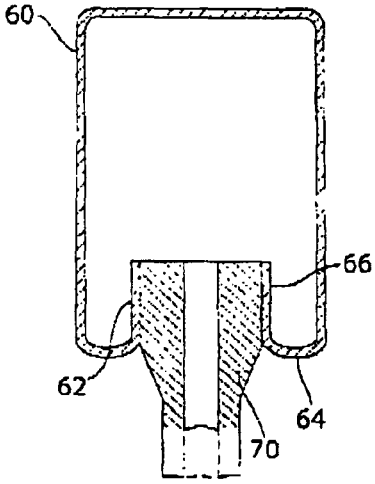
Figure 9E:
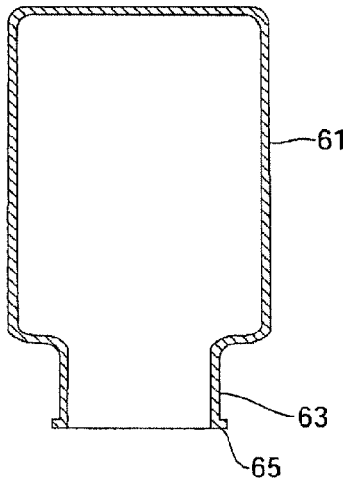
Figure 9F:
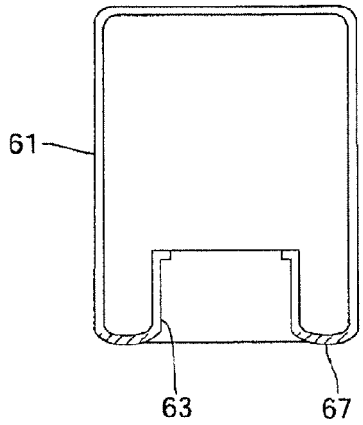
Figure 9G:
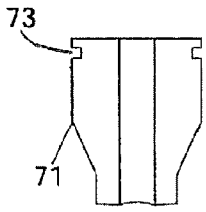
Figure 9H:
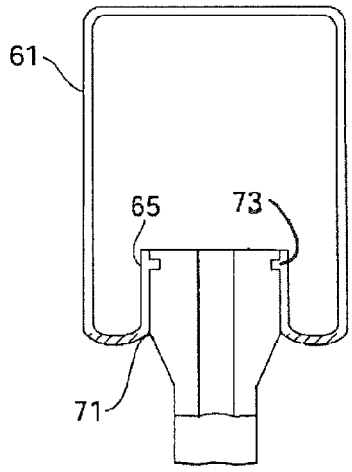

FIGS. 9A-9F illustrate two methods of coupling a bladder 60 to a post 70 to obtain a smooth rolling motion of the bladder onto the post via a curved region 64. A bladder 60 with a neck region 62 is shown in cross section in FIG. 9A. The neck may first be inverted, as shown in FIG. 9B, creating a curved region 64. A post 70 is provided (FIG. 9C), and the bladder may be slid onto post 70 and sealed with a layer of adhesive 66, as shown in FIG. 9D. The adhesive may, for example, be applied to post 70 before its insertion into neck region 62.

FIG. 9E-9H illustrate installation of a bladder with a collar, similar to FIGS. 8A and 8B. The bladder 61 has a neck 63 and collar 65 (FIG. 9E), and is inverted (FIG. 9F) forming a curved region 67. The post 71 has a notch 73 into which collar 65 fits. When the post 71 is inserted into the neck region 63, the collar 65 snaps into the notch 73. For low pressures (e.g., 1-10 PSI), this method of sealing may provide sufficient sealing without the use of adhesives. However, adhesives may be applied as in FIG. 9D.

Figure 10A:
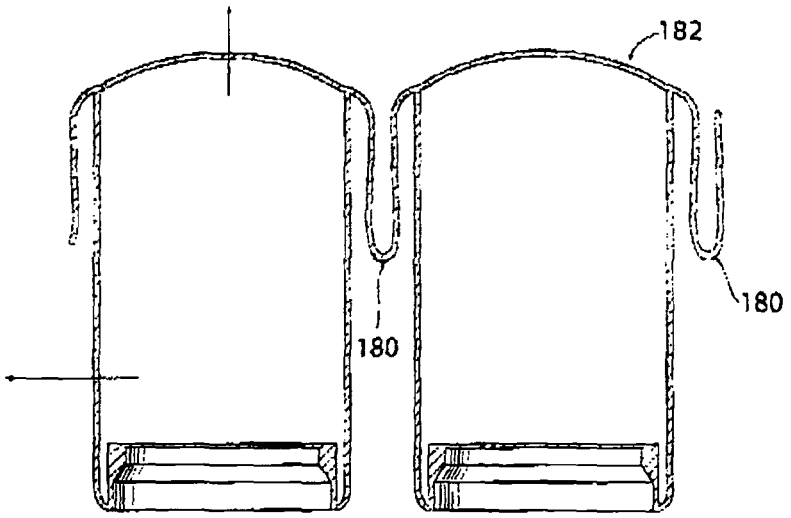
FIGS. 10A-10B are schematic illustrations of a disposable patient contacting surface for the support device according to another embodiment.
Figure 10B:
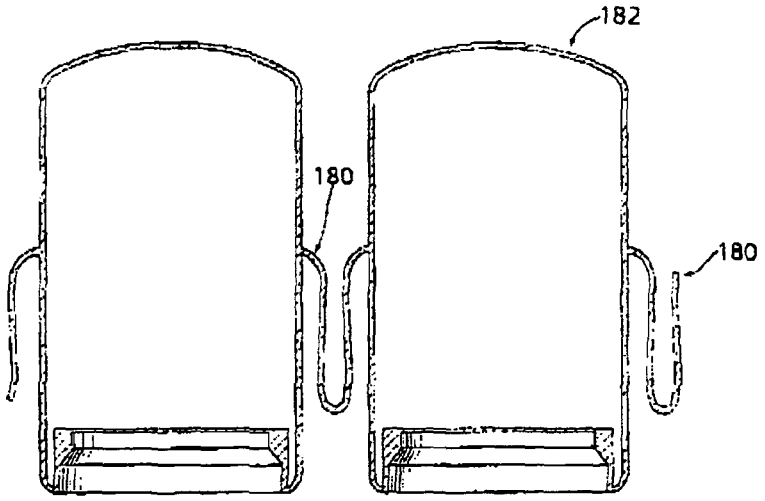

FIGS. 10A-10B illustrate a cross-section of two bladders having a type of connecting surfaces 180 between adjacent bladders. The connecting surfaces 180, and the tops 182 of the bladders may have coatings placed thereon for patient comfort. The entire connection surface may be made in the form of a sheet which is adhered to the bladders of an array, and drapes between then. The arrows shown in FIG. 10A depict possible air flow which may be in an embodiment with ventilation on top of or on any surface of the bladder or the patient contacting surface which may help reduce moisture on the patient contacting surface.

Figure 11:
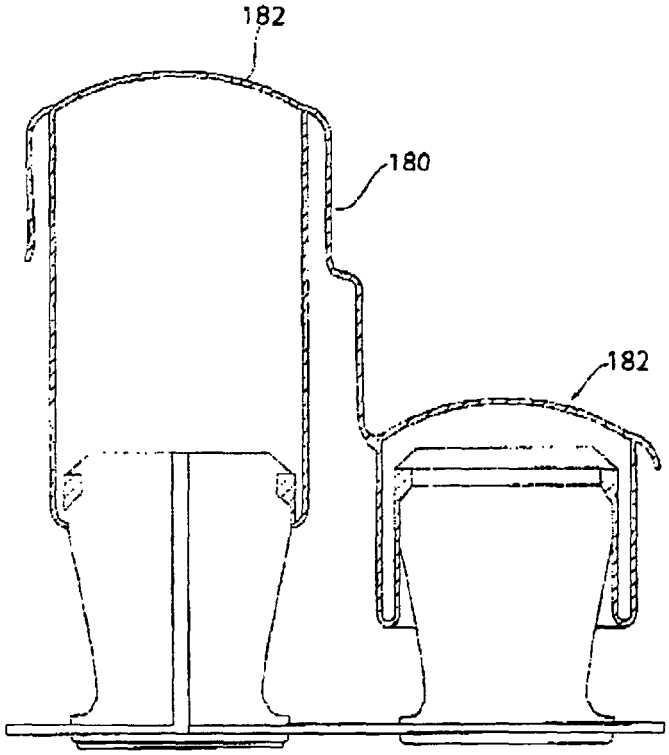
FIG. 11 is a schematic illustration of a support device according to another embodiment.

FIG. 11 illustrates the movement of the connecting surfaces when there is a large disparity in the degree to which the top surfaces of adjacent bladders are differentially depressed. A covering material with a fabric, weave and/or stretch may allow the translation of the reduced pressure effect. In some embodiments, the use of a cover may reduce and/or eliminate the reduced pressure effect. A covering as shown in FIG. 11 that allows for independent movement of elements or small groups of elements according to the anatomy may be fashioned from available materials in the specialty fabric industry.

Figure 12:
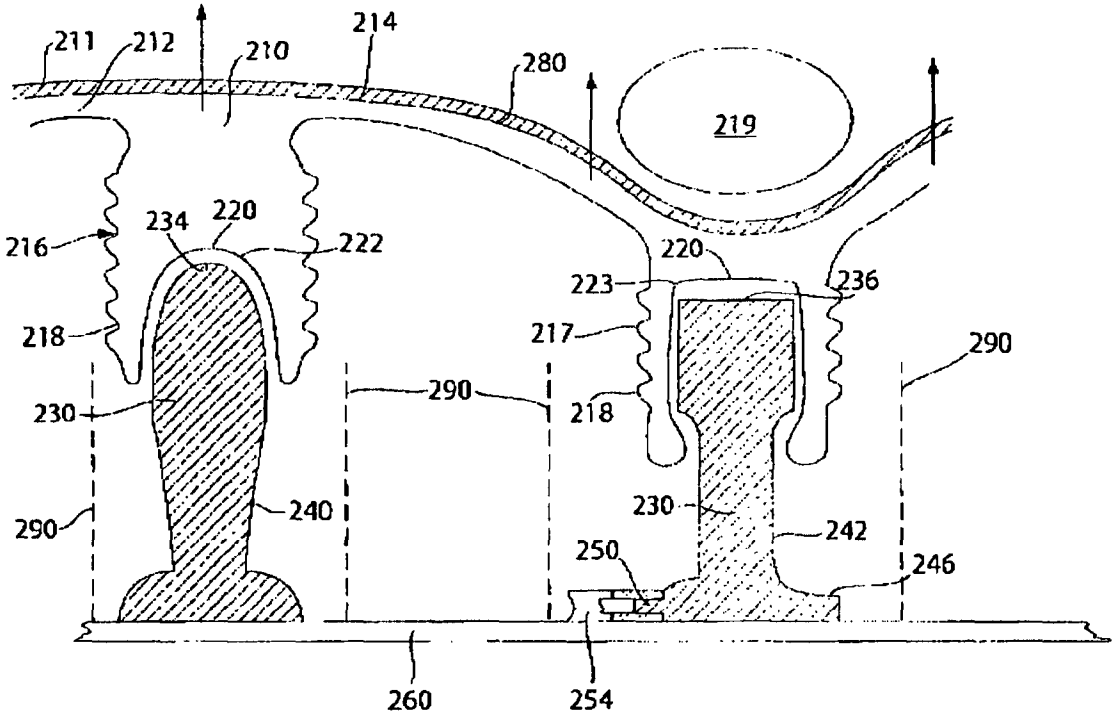
FIG. 12 is a schematic illustration of a support device according to yet another embodiment.

Another embodiment of a support device according to the present invention is illustrated in FIG. 12. Some of the above described embodiments include individual bladders coupled to posts, and a top covering layer may be adhered to the bladders. Some of the above described embodiments also include fluid being supplied to the bladders through a channel within the posts.

In the embodiment shown in FIG. 12, the upper surface 211 of the support device, such as a cushion or bed, may be removable and disposable, which may simplify sanitation. FIG. 12 illustrates a cross-sectional view of a support device with a removable surface 280. In particular, the embodiment shown in FIG. 12 includes at least one bladder 210, and only a single bladder 210 in certain embodiments, capable of containing a fluid. As shown, the bladder of this embodiment includes at least one fluid inlet 212 and an upper surface 214.

The at least one bladder 210 is positioned over a plurality of posts 230. Each post may have an upper contacting region 234 or 236 where contact with the bladder is made. In some embodiments, the posts may also have a taper 240 or a discrete indentation 242, or other form of tapering, to give the above-described decrease in resistance upon travel to discrete areas of the bladder positioned adjacent to and supported by the posts. As noted above, a post of the invention may have an outward (increasing) taper or step 246 at the bottom to provide a gradual stop or foot when depressed too far. In some embodiments, the posts may be inflatable through an inflation lumen 250 and connector 254. In another embodiment, the posts may be solid, and may optionally be made from a resilient material and/or with resilient material attached to the top surface 234 or 236 of the post. In this embodiment, the posts may be fixed to a supporting frame 260.

In this particular embodiment, the at least one bladder 210 includes a plurality of regions 216 and 217 adjacent each post. As shown, bladder region 217 is depressed in height by a weight 219. Each inflatable bladder region may include a flexible sidewall 218 and a post-contacting region 220, which may have a preformed shape, such as the dome shape of contact region 222 of bladder 216 or the flat contact region 223 of bladder 217.

Flexible guides 290 may be provided to orient the bladders. In this particular illustrative embodiment, the guides 290 are essentially cylindrically shaped and may, for example, be made of elastic cording or fabric. The guides 290 may encircle each post to help orient the bladder portions 216, 217, etc to the posts 230. It should be appreciated that in some embodiments the guides may be shaped differently, such as, but not limited to, square shaped, triangular shaped, etc. Connecting region 280 of at least one 210 may act similar to the connector 30 of FIG. 1, providing fluid communication between bladder regions 216 and 217.

The upper portion 211 may be disposable and may be installed row by row, for example, and the upper portion 211 may be coupled to selected portions of the bladder 210 with a reversible contact adhesive. In one embodiment, the upper portion 211 may be removably coupled to the bladder with a fastener such as VELCRO®. Pressure may be put into the upper portion 211 to partially inflate the bladder which may assist in locking the bladder in an oriented state on the posts. After correction of any mismatches and re-inflation, the support device may be ready to be used. Bladder region 216 (left) shows the state with no applied weight, and bladder region 217 (right) shows the effect of weight 219 being applied. In this embodiment, the bladder region in the weight-bearing region is still in the linear zone and does not yet have the low resistance region 242 in operation. The arrows in FIG. 12 depict optional air flow for ventilation on top of or one any surface of the bladder.

Supporting Data for the Invention

According to certain aspects of the present invention, a profile of pressure reduction as a function of compression is evident in contrast to similar profiles for foam-based pressure relieving mattresses. Supporting data for several embodiments are presented below and compared with data for a foam mattress.

Figure 13A:
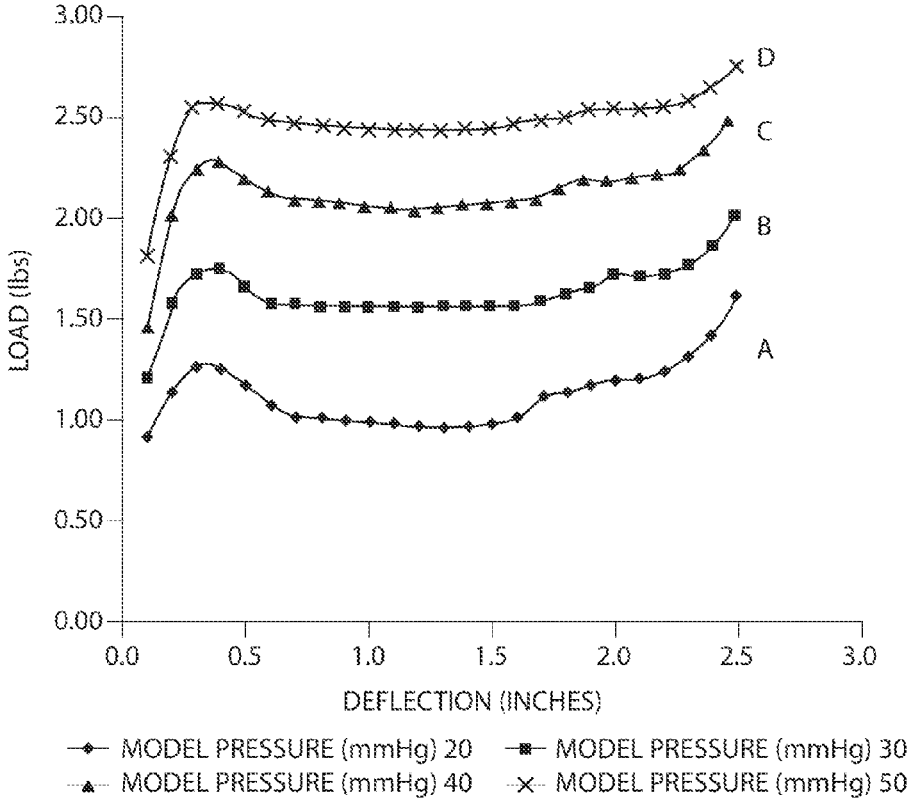
FIG. 13A is a graph of load vs. deflection for a support device at various pressures according to another embodiment.
Figure 13B:
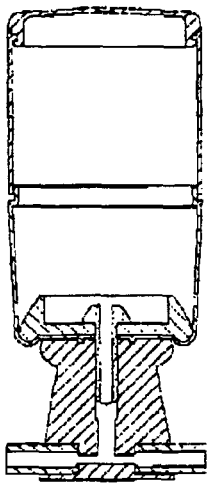
FIGS. 13B-13C are schematic illustrations of a support device used to generate the data in FIG. 13A.
Figure 13C:
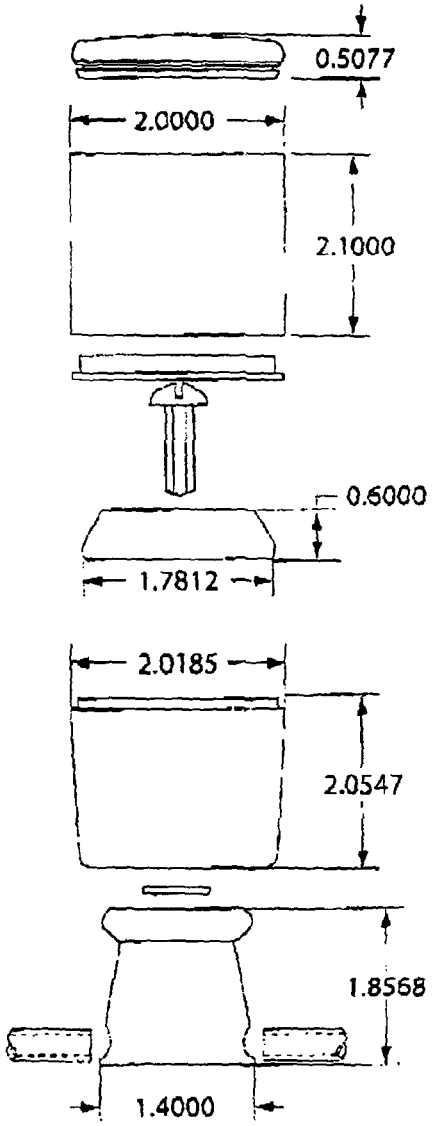

In particular, FIG. 13A illustrates measurements on a single module of the invention at four internal pressures wherein a known load is placed on the top of the module compressing the bladder down along the length of the post. The internal pressures represented are: Curve A, 20 mm Hg (diamonds); Curve B, 30 mm Hg (squares); Curve C, 40 mm Hg (triangles); Curve D, 50 mm Hg (crosses). The dimensions of the support device module used in this particular test are illustrated in FIGS. 13B-13C. Five support device modules with dimensions as in FIGS. 13B-13C were tested in load-deflection at the nominal inflation pressure of 30 mm-Hg and were found to have essentially identical results. One of the modules was load-deflection tested at four pressures (20, 30, 40 and partially 50 mm-Hg). The load measurements were made on a Chatillon Force Measurement Instrument recently calibrated and certified. Air was pumped into the module via tubing connections to outlet 152 (FIG. 3) using a small air pump for home use at 0.03 gal/min, 150 mm-Hg max. 115 VAC. A sphygmomanometer gauge 0-200 mm-Hg and a standard forward pressure regulator 0-150 psi were used to control the internal pressure and to maintain positive pressure. The rate of change in deflection or displacement was set at 0.4" per minute to minimize transition effects. Measurements were recorded of both load and deflection at +/−0.1" intervals over the entire stroke of the module. Zero setting was achieved by adjusting starting position with a load of 0.01" on the module top. The surface area of the module top is 4 in sq.

According to the data in FIG. 13A, the trend for all the pressures measured show an initial increase in load with deflection for approximately 0.25" followed by a reduction in load to approximately 0.6". The curves for all pressures remain reduced relative to the initial peak up to approximately 2" and end with increasing load toward the last 0.6" of the stroke. The higher the internal pressure the larger the initial peak, as seen in Curve D, for example, consistent with the mechanism as described earlier. The first portion of the stroke compresses the air in the diaphragm which must overcome resistance to rolling over the lip of the base post accounting for the initial peak and the increasing peak as a function of internal pressure.

Subsequently, as the diaphragm rolls over the top of the post and engages the reduced diameter region of the post, a reduction in slope of the load is seen. As the post diameter increases towards the base of the post the load correspondingly increases till the diaphragm material encounters the actual base unit and is bottomed out. The behavior as described is consistent with observation and mechanism as detailed in previous sections.

Figure 13D:
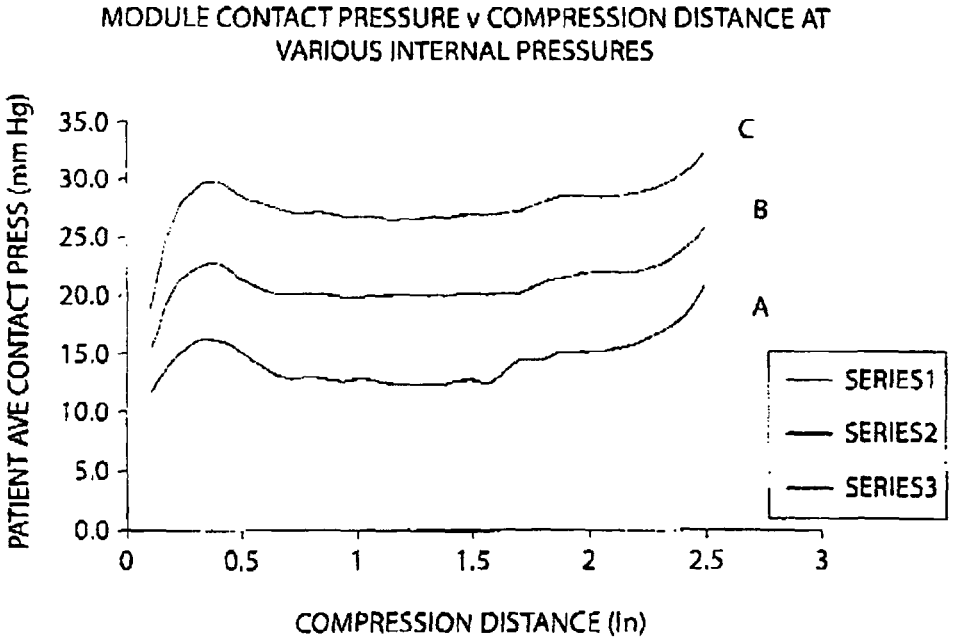
FIG. 13D is a graph of Contact Pressure vs. Compression Distance for a support device at various pressures according to yet another embodiment.

FIG. 13D illustrates the calculated contact pressure based on the load deflection data presented in FIG. 13A using a supporting surface area of approximately 2 $in^2$ representing the top of the support device module in this case. The calculated contact pressure for all curves is below 32 mm Hg as shown for Curve A, 40 mm Hg (upper curve), Curve B, 30 mm Hg (middle curve) and for Curve C, 20 mm Hg (lower curve).

Figure 14:
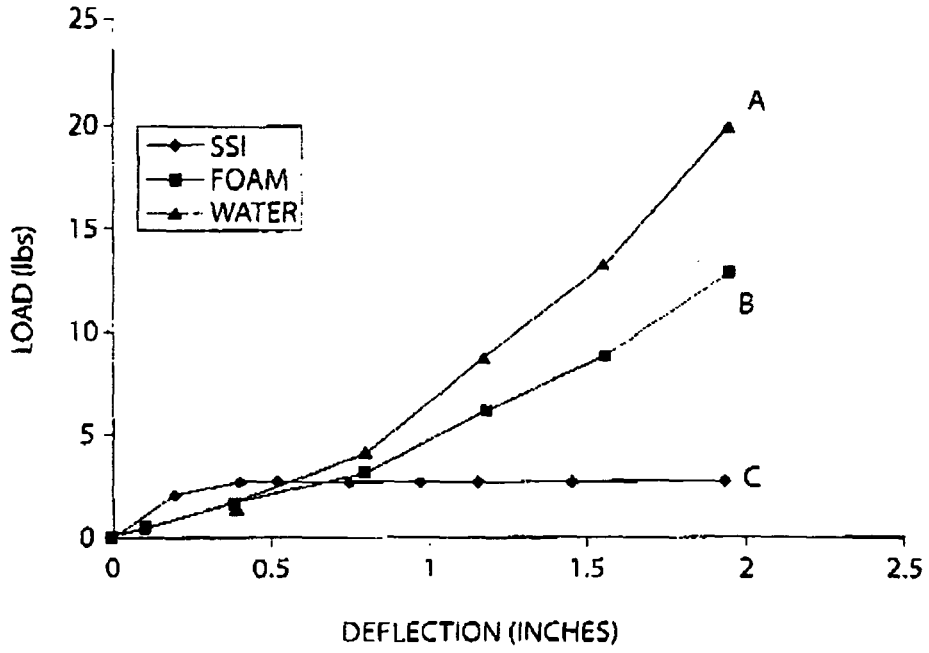
FIG. 14 is a graph of load vs. deflection for a support device according to one embodiment compared to data for a foam mattress and a water bed.

The load deflection profiles for some embodiments of the present invention described herein in comparison to that for a foam and water mattress is shown in FIG. 14. The data for the foam, Curve B and water mattress, Curve A, are adapted from Small, C. F. (1980) Flat Circular Punch Testing of Clinical Support Devices *IMechE* 9(1): 1-15, and measured in a similar fashion with similar surface area of 5 cm diameter plate which compares with the 4 square inch surface of the support device module tested. According to the data it can be readily seen from curves A and B that the foam and water mattress have typical curves reflecting increasing load with deflection characterized by steeply increasing positive slopes attaining up to 20 lbs pressure over a compression of about 2". In comparison with the foam mattress the load-deflection curve for one embodiment of the present invention, Curve C, is flat and slightly decreasing in slope in a portion of the stroke. Based on the comparison of published data and data for the module of the invention measured directly in the laboratory, certain embodiments of the present invention described herein may offer reductions in load and therefore pressure of approximately 38% and 75% at deflections of 1" and 2", respectively, compared to a typical high density foam mattress. The reductions in load observed for a single support device module will also apply to arrays with a plurality of modules and offer pressure reduction in magnitude and in a manner not currently available to the pressure reducing mattress industry or to those suffering from pressure related ulcers.

While several embodiments of the invention have been described and illustrated herein, those of ordinary skill in the art will readily envision a variety of other means and structures for performing the functions and/or obtaining the results or advantages described herein, and each of such variations, modifications and improvements is deemed to be within the scope of the present invention. More generally, those skilled in the art would readily appreciate that all parameters, dimensions, materials, and configurations described herein are meant to be exemplary and that actual parameters, dimensions, materials, and configurations will depend upon specific applications for which the teachings of the present invention are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described. The present invention is directed to each individual feature, system, material and/or method described herein. In addition, any combination of two or more such features, systems, materials and/or methods, provided that such features, systems, materials and/or methods are not mutually inconsistent, is included within the scope of the present invention. All definitions, as defined and used herein, should be understood to control over dictionary definitions, definitions or usage in documents incorporated by reference, and/or ordinary meanings of the defined terms.

In the claims (as well as in the specification above), all transitional phrases or phrases of inclusion, such as "comprising," "including," "carrying," "having," "containing," "composed of," "made of," "formed of," "involving" and the like shall be interpreted to be open-ended, i.e. to mean "including but not limited to" and, therefore, encompassing the items listed thereafter and equivalents thereof as well as additional items. Only the transitional phrases or phrases of inclusion "consisting of" and "consisting essentially of" are to be interpreted as closed or semi-closed phrases, respectively. The indefinite articles "a" and "an," as used herein in the specification and in the claims, unless clearly indicated to the contrary, should be understood to mean "at least one."

What is claimed is:

1. A device for supporting at least a portion of a user's body, the device comprising:

a plurality of bladders capable of containing a fluid, the plurality of bladders including at least a first bladder and a second bladder; and a plurality of posts adjacent to and supporting the plurality of bladders, such that at least one post is positioned adjacent to and supports each of the plurality of bladders, the plurality of posts including at least a first post and a second post, with the first post positioned adjacent to and supporting the first bladder and the second post positioned to adjacent to and supporting the second bladder, wherein the first and second bladders each forms a rolling diaphragm portion with the first and second posts, respectively, such that when a force is applied to the first bladder, the rolling diaphragm portion of the first bladder rolls along the first post decreasing the volume of the first bladder, and when a force is applied to the second bladder, the rolling diaphragm portion of the second bladder rolls along the second post decreasing the volume of the second bladder.

2. The device of claim 1, further comprising a pressurized fluid source.

3. The device of 2, wherein the pressurized fluid is air.

4. The device of claim 1, further comprising a channel fluidly connecting the first bladder to the second bladder such that when the first and second bladders are filled with a fluid, the pressure within the first bladder is capable of reaching an equilibrium with the fluid pressure within the second bladder.

5. The device of claim 4, wherein at least a portion of the channel fluidly connecting the first bladder to the second bladder extends through at least one of the first post and the second post.

6. The device of claim 1, wherein the cross-sectional area of the post is substantially constant.

7. The device of claim 1, wherein the first post includes at least one region having a reduced cross-sectional area in comparison to an adjacent region of the first post such that the resistance of the rolling diaphragm portion of the first bladder to rolling movement along the first post due to the applied force decreases as the bladder rolls along the at least one region having a reduced cross-sectional area.

8. The device of claim 7, wherein the cross-sectional area of the first post tapers from the at least one region having a reduced cross-sectional area to the adjacent region of the first post.

9. The device of claim 1, wherein the cross-sectional area of the first post is different than the cross-sectional area of the second post.

10. The device of claim 1, wherein at least the first bladder is coupled to the first post.

11. The device of claim 1, wherein the plurality of bladders includes a third and fourth bladder, and the plurality of posts includes a third and fourth post, with the third post positioned adjacent to and supporting the third bladder and the fourth post positioned adjacent to and supporting the fourth bladder at least a portion of the third and fourth bladders each forming a rolling diaphragm portion with the third and fourth posts, respectively, such that when a force is applied to the third bladder, the third bladder rolls along the third post decreasing the volume of the third bladder, and when a force is applied to the fourth bladder, the fourth bladder rolls along the fourth post decreasing the volume of the fourth bladder; and wherein the first and second bladders and the first and second posts define a first zone, and the third and fourth bladders and the third and fourth posts define a second zone.

12. The device of claim 11, wherein the pressure in the first zone is different than the pressure in the second zone.

13. The device of claim 11, wherein the cross-sectional area of first or second posts are different than cross-sectional area of third or fourth posts.

14. The device of claim 1, wherein at least the first post is inflatable.

15. The device of claim 1, wherein the first bladder is attached to the second bladder.

16. A device for supporting at least a portion of a user's body, the device comprising:

at least one bladder capable of containing a fluid; and a plurality of posts adjacent the at least one bladder, the plurality of posts including at least a first post and a second post, wherein at least a portion of the at least one bladder forms a first and second rolling diaphragm portion with the first and second posts, respectively, such that when a force is applied to the at least one bladder at a location adjacent the first post, the first rolling diaphragm portion of the at least one bladder rolls along the first post decreasing the volume of the at least one bladder, and when a force is applied to the at least one bladder at a location adjacent the second post, the second rolling diaphragm of the at least one bladder rolls along the second post decreasing the volume of the at least one bladder.

17. The device of claim 16, further comprising a pressurized fluid source.

18. The device of 17, wherein the pressurized fluid is air.

19. The device of claim 16, wherein the at least one bladder includes at least a first bladder and a second bladder.

20. The device of claim 19, further comprising a channel fluidly connecting the first bladder to the second bladder such that when the first and second bladders are filled with a fluid, the pressure within the first bladder is capable of reaching an equilibrium with the fluid pressure within the second bladder.

21. The device of claim 16, wherein the cross-sectional area of the first post is substantially constant.

22. The device of claim 16, wherein the first post includes at least one region having a reduced cross-sectional area in comparison to an adjacent region of the first post such that the resistance of the first rolling diaphragm portion of the first bladder to rolling movement along the first post due to the applied force decreases as the bladder rolls along the at least one region of the post having a reduced cross-sectional area.

23. The device of claim 22, wherein the cross-sectional area of the first post tapers from the at least one region having a reduced cross-sectional area to the adjacent region of the first post.

24. The device of claim 16, wherein the cross-sectional area of the first post is different than the cross-sectional area of the second post.

25. The device of claim 16, wherein at least the first post is inflatable.

26. The device of claim 16, further comprising a protective covering extending along the at least one bladder.

27. The device of claim 16, comprising only one bladder.

28. A device for supporting at least a portion of a user's body, the device comprising:

a bladder capable of containing a fluid;

a post adjacent the bladder, wherein the bladder forms a rolling diaphragm portion with the post such that when a force is applied to the bladder, the rolling diaphragm portion of the bladder rolls along the post decreasing the volume of the bladder; and wherein the post includes at least one region having a reduced cross-sectional area in comparison to an adjacent region of the post such that the resistance of the rolling diaphragm portion of the bladder to rolling movement along the post due to the applied force decreases as the bladder rolls along the at least one region having the reduced cross-sectional area.

29. The device of claim 28, further comprising a pressurized fluid source.

30. The device of 29, wherein the pressurized fluid is air.

31. The device of claim 28, further comprising a channel in fluid communication with the bladder, wherein at least a portion of the channel extends through the post.

32. The device of claim 28, wherein the cross-sectional area of the post tapers from the at least one region having a reduced cross-sectional area to the adjacent region of the post.

33. The device of claim 28, wherein the bladder is coupled to the post.

34. The device of claim 28, wherein the post is inflatable.

* * * * *